US005839972A

United States Patent [19]

Swanson

[11] Patent Number: 5,839,972

[45] Date of Patent: Nov. 24, 1998

[54] GOLF BALL AND TEE POSITIONING AND RETRIEVAL DEVICE

[76] Inventor: Carl A. Swanson, 612 Brae Burn Dr., Augusta, Ga. 30907

[21] Appl. No.: 956,110

[22] Filed: Oct. 24, 1997

Related U.S. Application Data

[63] Continuation-in-part of Ser. No. 811,966, Mar. 5, 1997, abandoned.

[51] Int. Cl.[6] ..... A63B 57/00

[52] U.S. Cl. ..... 473/286; 473/386

[58] Field of Search ..... 473/284, 286, 473/386, 387; 294/19.1, 19.2

[56] References Cited

U.S. PATENT DOCUMENTS

| | | | |
|---|---|---|---|
| 1,658,145 | 2/1928 | Uyei | 473/286 |
| 2,609,198 | 9/1952 | Armstrong | 473/386 |
| 2,801,875 | 8/1957 | McEvoy | 473/286 |
| 2,943,856 | 7/1960 | Eimerman | 473/386 |
| 4,013,295 | 3/1977 | Baughman | 473/286 |
| 5,230,385 | 7/1993 | Dinatale | 473/286 |
| 5,423,543 | 6/1995 | Tarrant | 473/286 |

*Primary Examiner*—Steven Wong
*Attorney, Agent, or Firm*—Laurence R. Brown

[57] ABSTRACT

A golfer's pocket sized accessory is provided to permit a standing golfer to tee up golf balls, recover the tees after use, and to retrieve golf balls out of the cup. This accessory is made to clamp on the grip handle portion of a golf club in use. In a preferred embodiment a light weight plastic accessory has three plastic parts, a first unit for retaining the accessory on the golf club handle with accompanying O-ring movable between bistable positions on the clamp for attaching the accessory to the golf club handle and releasing it, and a golf and tee retrieval and retaining scoop unit. The two units are threaded for temporarily mating the ball and tee in teeing posture by twisting the retaining unit and scoop unit. The scoop has a spherically shaped cavity for retaining the golf ball, and for picking the ball out of a cup/by the accessory.

12 Claims, 10 Drawing Sheets

GOLF BALL AND TEE POSITIONING AND RETRIEVAL DEVICE

This is a Continuation-in-part of my application Ser. No. 08/811,966 filed Mar. 5, 1997. Abandoned.

TECHNICAL FIELD

This invention relates to golfing accessory instruments and more particularly it relates to instruments for enabling a standing golfer to place or remove a tee and to retrieve a golf ball.

BACKGROUND OF THE INVENTION

Many golfers have a difficult time bending over to position a golf ball and tee into the ground during a round of golf. This may be due to factors such as bad backs, knees, or hips, arthritis, or any number of similar ailments. This invention seeks to relieve such persons from the stress these acts place on their bodies.

Known prior art instruments for assisting golfers to retrieve a golf ball or tee present a number of problems, for example, they are not of a size small enough to fit in one's pants pocket. Typical prior art is now discussed.

U.S. Pat. No. 5,499,813 shows a tee positioning apparatus that requires a spring and plunger mechanism to provide functionality. Additionally, it cannot readily be transported on the golf course because of its large size.

U.S. Pat. No. 5,330,178 also requires a spring for functioning and requires a permanently affixed pole. U.S. Pat. No. 4,951,947 uses a plunging mechanism to function and is permanently affixed to a pole. U.S. Pat. No. 5,439,213 uses a spring to function, is permanently affixed to a pole and could not properly position the ball and tee without many attempts.

Thus the known prior art devices use some form of spring or plunging action to work, are big and/or bulky, or are permanently fixed to long sticks, tubes, or shafts.

SUMMARY OF THE INVENTION

The instrument provided by this invention is a portable and manually operated golf aid used to set a golf ball and tee in a driving position and retrieve a golf ball or tee. The purpose of this invention is threefold. First, it will assist in the teeing of a golf ball without the user having to bend down to insert the golf tee into the ground; secondly, it will assist in the retrieval of a golf ball from a golf hole; and thirdly, it will assist in the obtaining of either a golf ball or a golf tee from the ground by acting as a scoop.

This instrument is attached to the grip of a golf club or other similarly shafted apparatus thereby to grip a golf ball and tee and hold them in place in the instrument under pressure to seat the ball on the tee in a position which allows the ball to be struck by a golf club.

This instrument has a scoop shaped lower portion working head which thereby provides a novel method of use by a standing golfer. The tool is an accessory designed to attaching its upper portion to a golf club handle or other similar object, with a size and weight easy to carry and use. In addition to acting as a golf ball and golf tee positioning tool, the instrument will allow one to withdraw a golf ball from a golf hole located in a green by simply attaching the accessory to a putter handle or the like for inserting the working head into the hole. The ball will become lodged in the cradle as it is pushed into the hole.

This invention will also allow one to scoop a golf ball and/or golf tee from the ground without bending at the waist or knees. One only needs to attach the instrument to a golf club handle and scoop either the tee or ball into the shaped cradle with a slight sweep of the club.

The retrieving instrument afforded by this invention overcomes the deficiencies found within current devices due to the following incorporated features: a) a threaded screw cam mechanism, b) a pocket size for easy transport on the golf course, c) a distinct shape of the cradle in which the ball rests to facilitate pickup, d) an easier to use golf tee holder and retrieval mechanism, and e) slide-ring locking receptacle providing the utility of attaching the accessory of this invention to almost any type of golf club usually available to the golfer. It is superior as a golf ball or tee retriever due to the side opening shape of the cradle which allows either a ball or tee to be retrieved via a simple "scoop" of the retriever instrument. Additionally, this instrument is light weight and has an approximate overall length of three golf balls placed end to end.

BRIEF DESCRIPTION OF THE DRAWINGS

In the accompanying drawings, wherein like features carry similar reference characters throughout the various views.

THE PREFERRED EMBODIMENT

Figure 1:
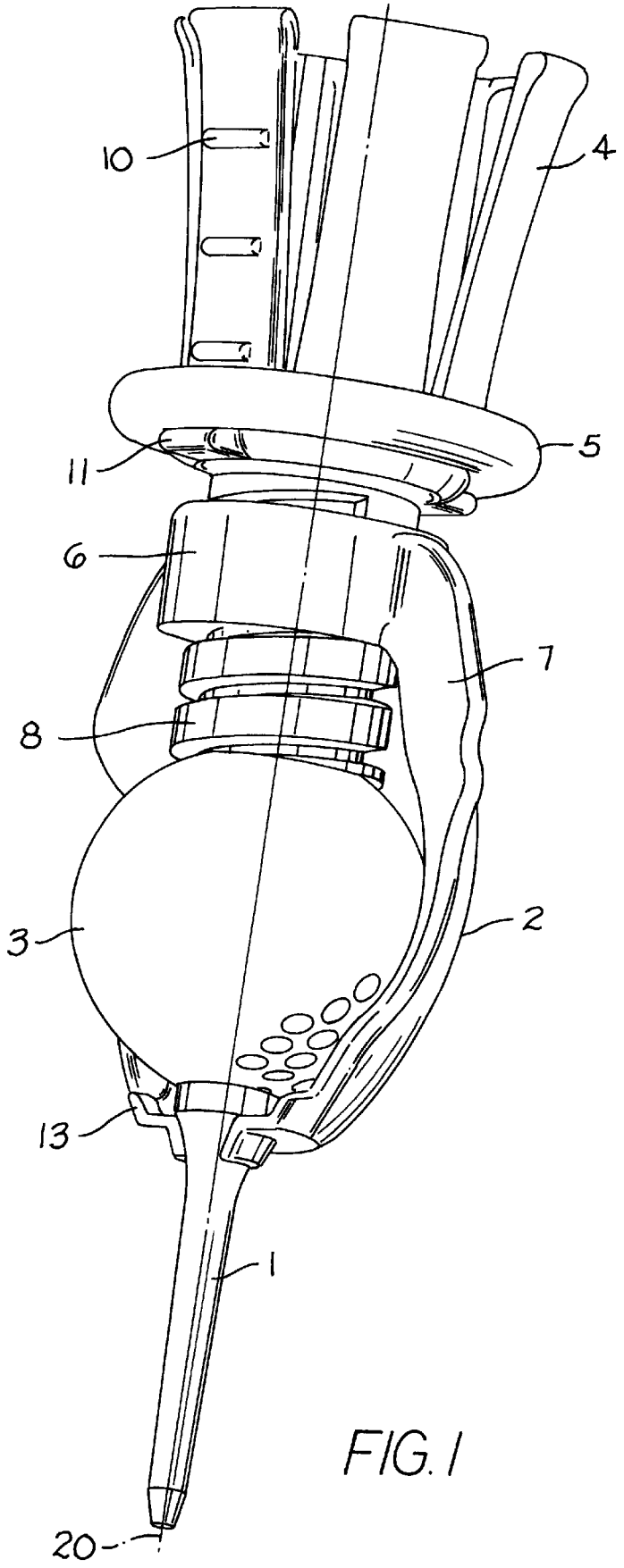
FIG. 1 is an isometric view looking into the scoop opening from the right front at a loaded ball and tee of the golf and tee retrieval accessory afforded by this invention.
Figure 8:
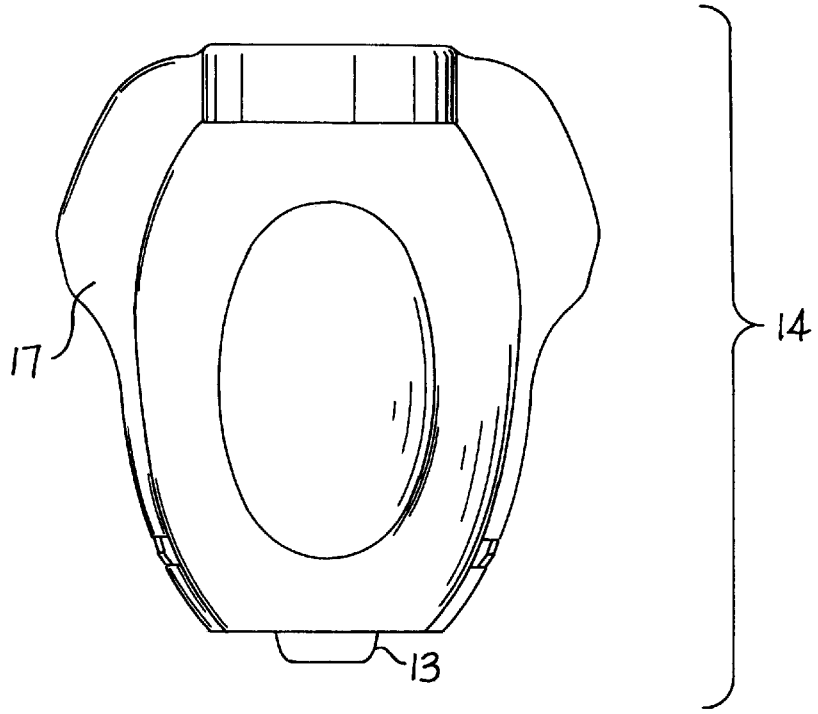
FIG. 8 is a back view of the scoop portion.
Figure 9:
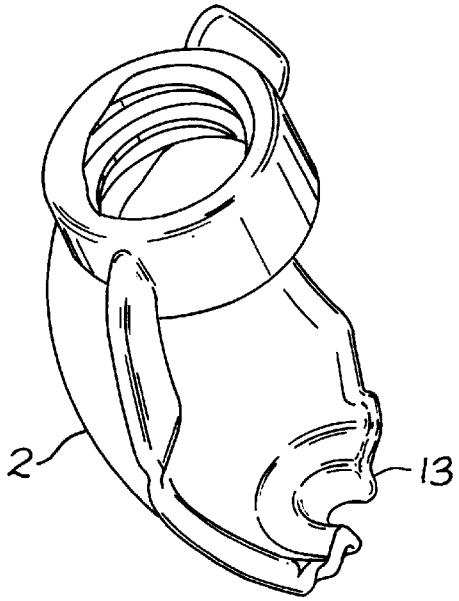
FIG. 9 is an isometric view of the scoop portion.
Figure 10:
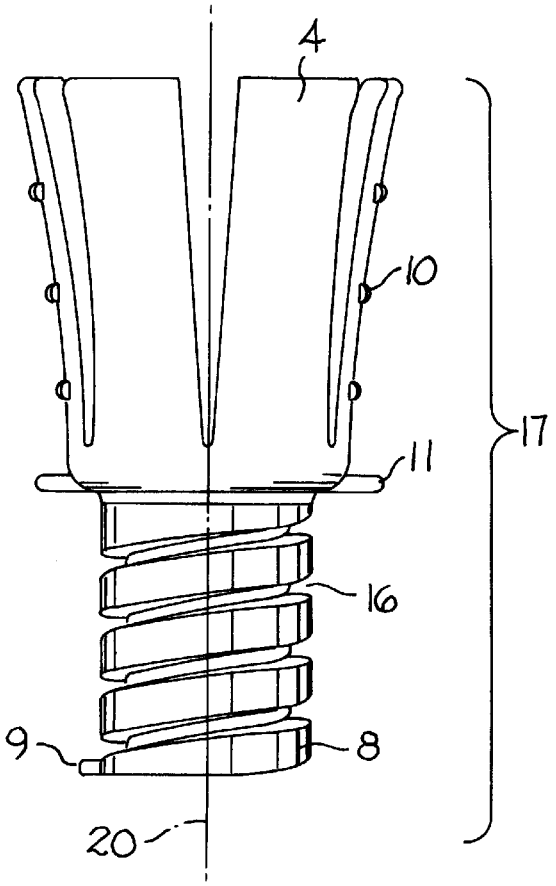
FIG. 10 is a side view of the retaining clamp assembly 17.
Figure 11:
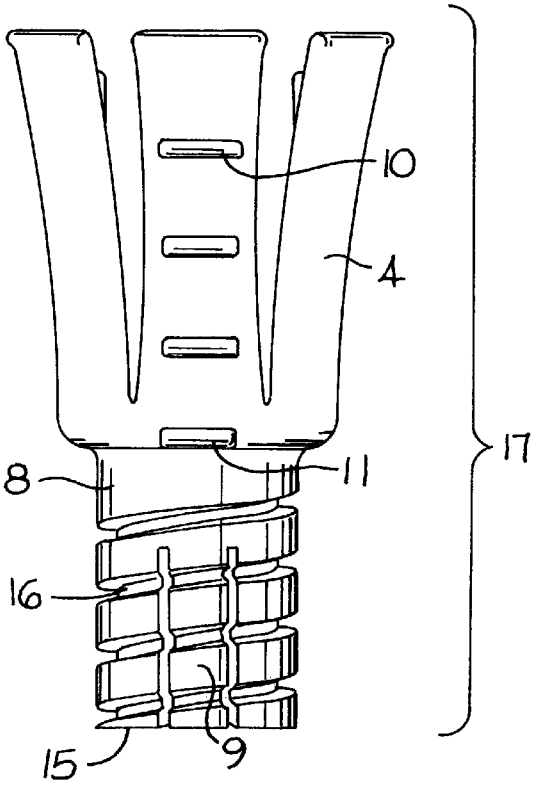
FIG. 11 is a front view of the retaining clamp assembly.
Figure 12:
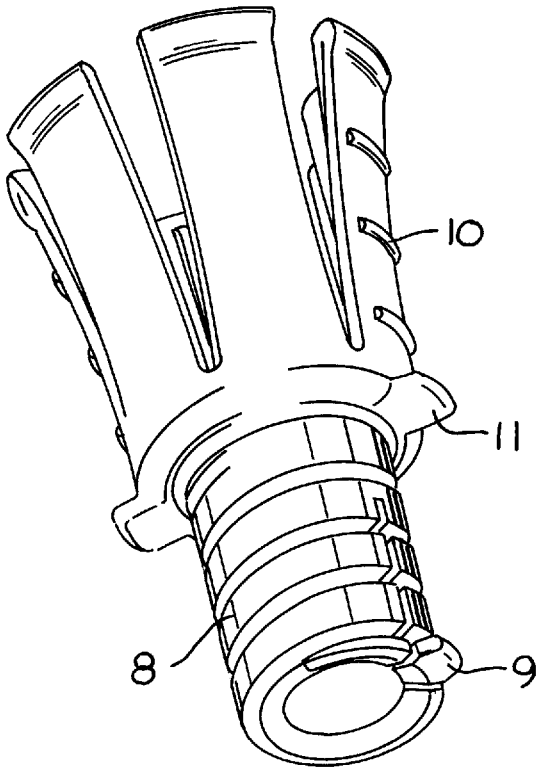
FIG. 12 is an isometric view of the retaining clamp assembly.

The accessory afforded by this invention, loaded with a golf ball 3 and golf tee 1 ready to place in the ground in a teed up position is shown in FIG. 1. The golf tee 1 is loaded into a substantially semi-cylindrical retaining golf tee seat and receptacle 13 recessed in the lowermost extremity of the accessory body to receive the tee head to align the tee with the coaxial axis 20. The head of the tee is mated with the golf ball 3 seated in a substantially semi-spherical concave cavity in the scoop-shaped receptacle cradle 2. The golf ball 3 placed on the tee and cradled in the scoop 2 is clamped in place by the open mouth of the hollow cylindrical tube 8, threaded on its outer surface. These threads mate with internally disposed threads on the collar 6 at the top end of the golf ball and tee receptacle unit 14 comprising the elements 2, 6 and 7, also shown in FIGS. 7 to 9.

The mating generally hollow cylindrically shaped coupling unit 21, also shown in FIGS. 10 to 13, which serves to couple this portable pocket sized accessory to the handle 18 of a golf club (FIG. 2), thus screws into the collar 6 to force the cammed end 15 (FIG. 10*b*) of tube 8 against the golf ball 3, thereby holding the golf ball 3 and tee 1 firmly in place to locate and discharge the ball and tee as a unit in a teed up position as the tee is forced into the ground.

Then to remove the accessory from the teed up ball and tee, the toe of a golfer's shoe is placed against the flanges 7 on opposite sides of the scoop cradle 2 to unscrew and retract the cylindrical pipe 8 by rotating the coupling unit 17 (FIG. 10) as the golf club shaft is rotated. The scoop cradle 2 is then removed to leave the golf ball 3 and tee 1 in teed up position. Thus, a golfer can operate this accessory from a standing position to tee up the ball.

After hitting the ball the golfer can also retrieve the tee I from the ground with the accessory by means of the tee retaining receptacle 13. Furthermore the golfer can also retrieve a ball from the cup by inserting the scoop cradle 2 into the cup to pick up the ball without bending over.

This accessory is carried in the pocket, if desired, and when it is ready for use it is readily and simply attached to the handle grip of a golf club 18 (FIG. 2) by inserting the handle 18 into the cradle formed by the set of fingers 4 elastically converging toward the top as shown in FIG. 1, and then simply clamping the flexible elastic fingers tightly about the handle by upward movement of O-ring 5 from its shown resident bistable position. This clamp preferably is made of a suitable flexible plastic material from which the two units 14 and 17 are molded into a single integrally molded piece. An impact co-polymer polypropylene, for example, is a material of significant strength for supporting threads, is selflubricating, and has elastic properties for the clamping fingers 4.

It is seen that the ridged tabs 10 and 11 on a diametrically opposite pair of the fingers 4 form detents to hold the O-ring 5 in stable positions with various degrees of clamping force. The stable rest position is as shown with the O-ring 5 seated on the tabs 11. Thus the fingers 4 collapse around the grip 18 of the golf club (FIG. 2) and apply pressure as the sliding collar ring 5 is moved upwards from its stable rest position.

Figure 2:
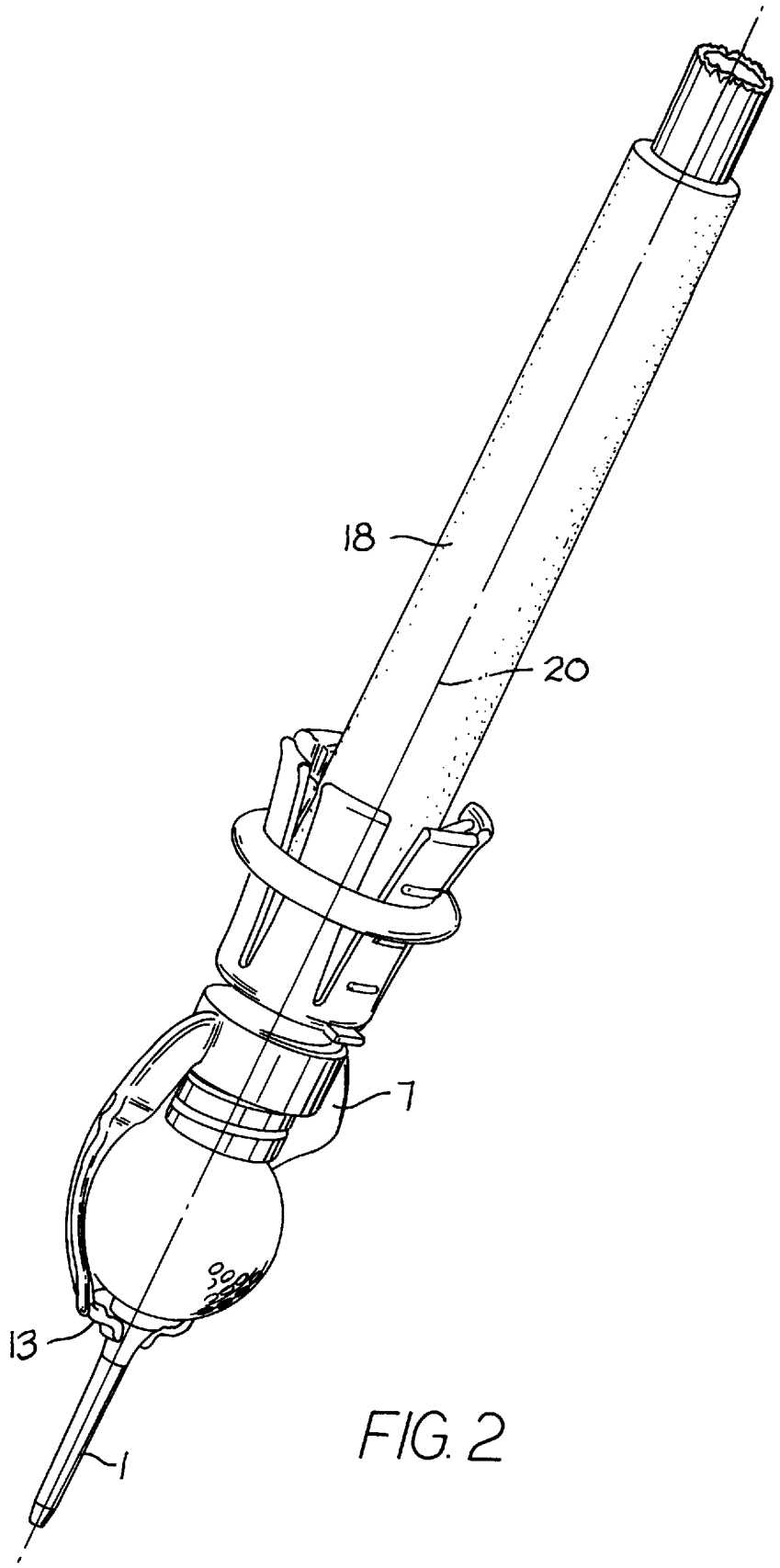
FIG. 2 is a front view of the accessory showing how it is attached to a golf club handle for use with a golf ball and tee held in place for teeing up.

FIG. 2 shows the accessory with clamped in golf ball and tee attached to a golf club grip 18 ready to tee up. If desired a separate shaft could be carried in a golf bag, but it is an objective of this invention to provide a light weight accessory that can be easily carried, and it works well when attached to a golf club grip, and the golfer will always have a club in hand when ready to use this accessory.

Figure 3:
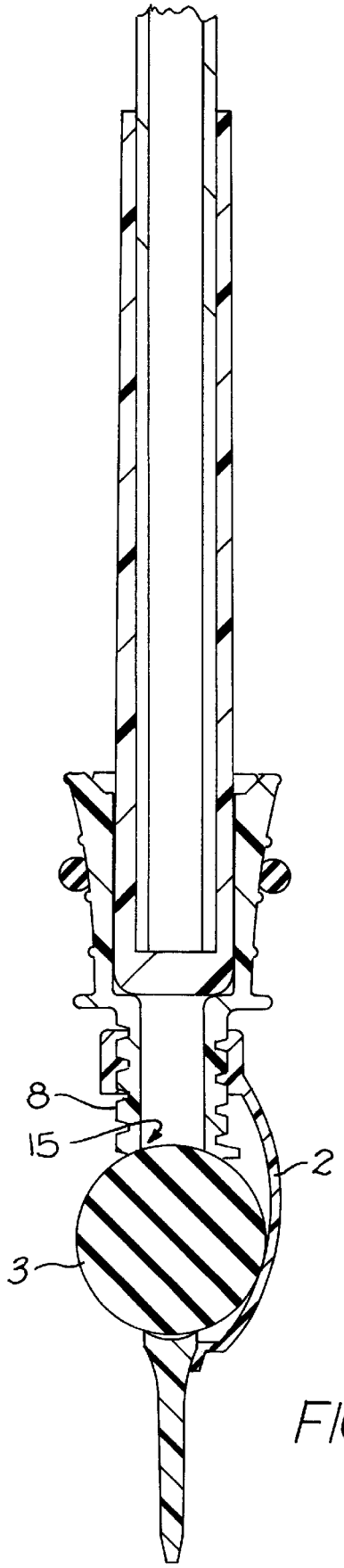
FIG. 3 is a cross-section side view of this accessory with the scoop opened to the left as attached to a golf club handle with loaded golf ball and tee ready to tee up.

FIG. 3 in cross section drawn through the axis (20) shows the seating of the tee 1, the golf ball 3 and the golf club handle 18 in place. The manner in which the golf ball 3 and tee 1 are held in the cradle 2 with the golf ball 3 clamped against the bottom mouth 15 of the threaded-screw hollow tube 8 is shown.

Figure 4:
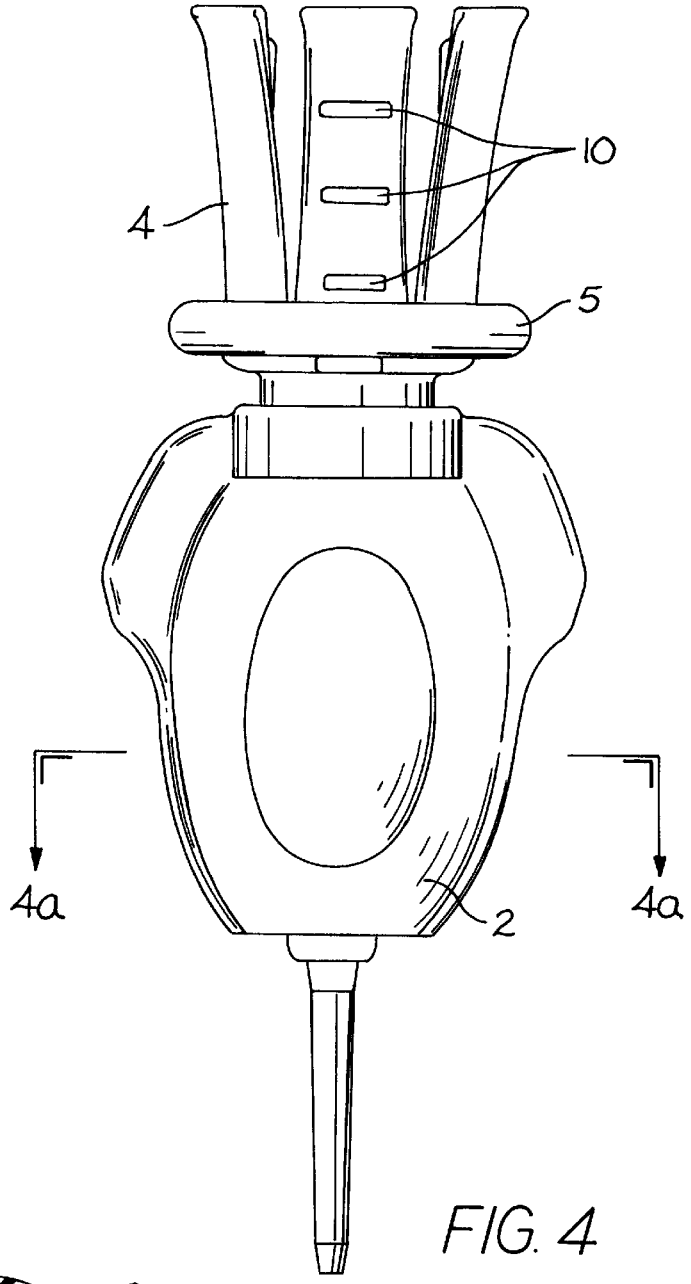
FIG. 4 is a back view of the accessory loaded with a ball and tee with the scoop pointed to the rear.
Figure 4A:
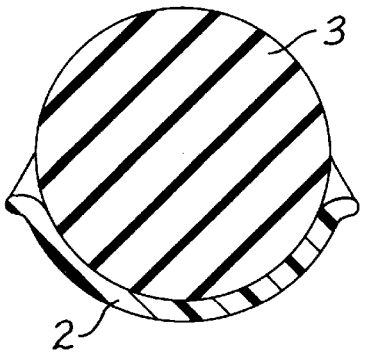
FIG. 4*a* is a cross-sectional view looking downwardly from B—B in FIG. 4.

FIG. 4 is a rear view of the accessory holding a golf ball and tee with FIG. 4*a* being a section view as indicated at lines a—a. This shows the cradle matrix fit of the golf ball 3 into the generally hemi-spherical body cavity of the scoop shaped receptacle 2.

Figure 5:
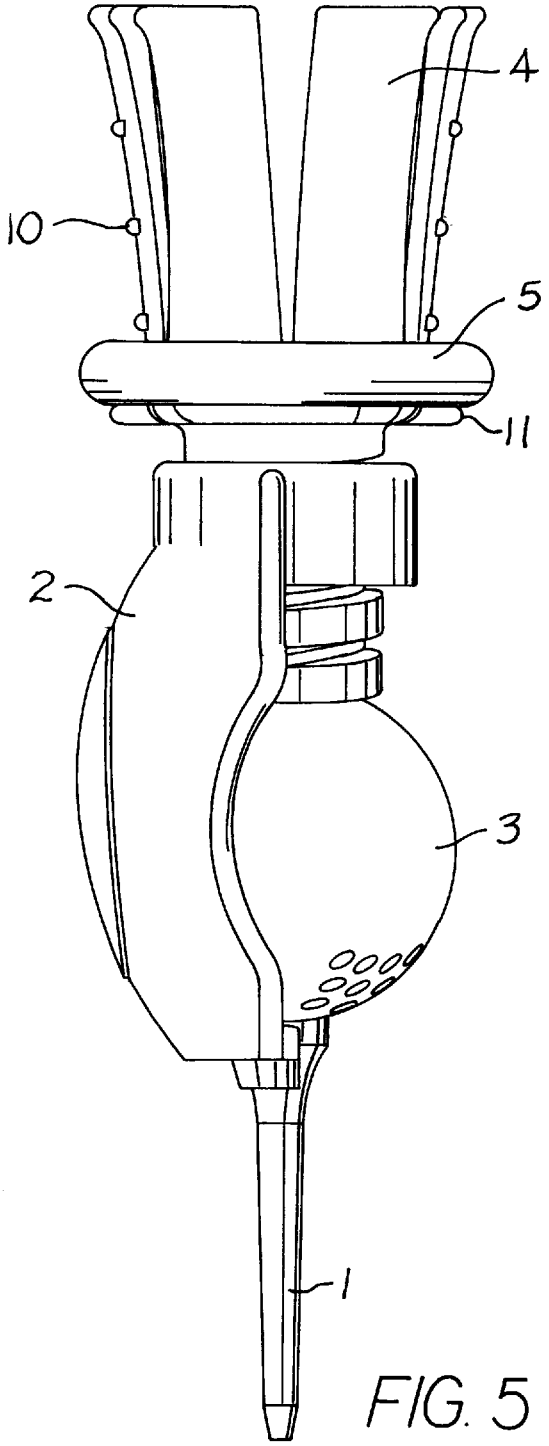
FIG. 5 is a side view with the scoop opening to the right.
Figure 6:
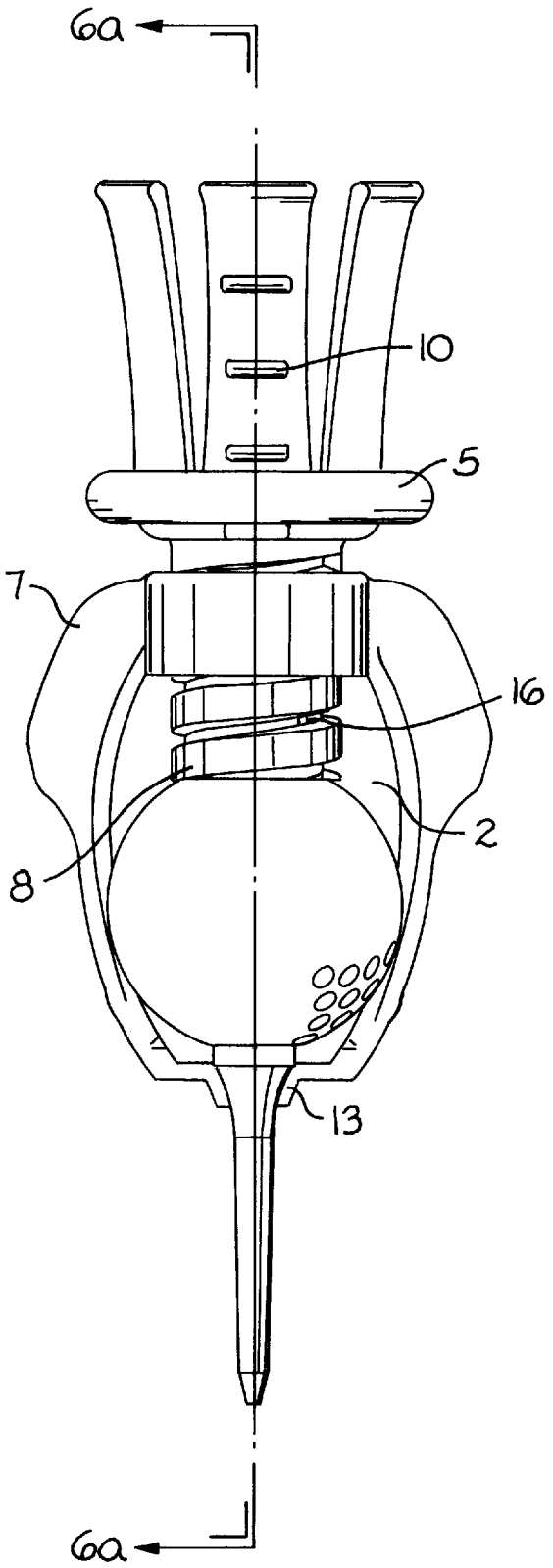
FIG. 6 is a front view.
Figure 6A:
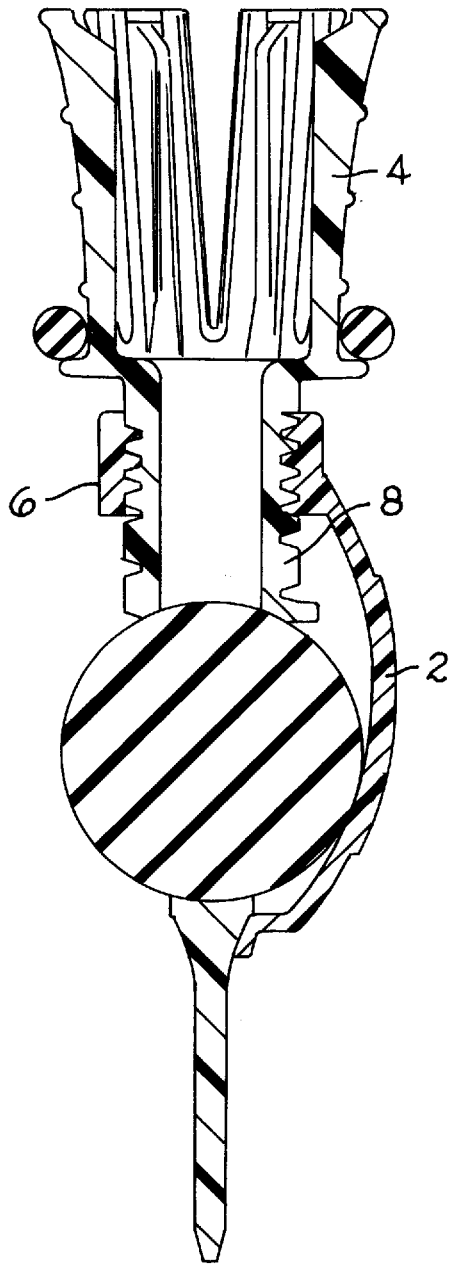
FIG. 6*a* is a cross-section view of segment A—A of FIG. 6.

FIG. 5 is a side view of the invention showing the actual proportions with respect to a golf ball 3, namely having a slightly larger maximum diameter and about three golf balls long. This view along with the front and section views of FIGS. 6 and 6*a* show the outer curvature of the scoop 2 cradle, as well as a frontal view of the toe tab 7. The concave curvature of the scoop cradle cavity 2 allows one to scoop balls 3 and tees 1 from the ground. A typical preferred pitch and diameter of the threads is seen by association with the size of the golf ball 3.

Figure 7:
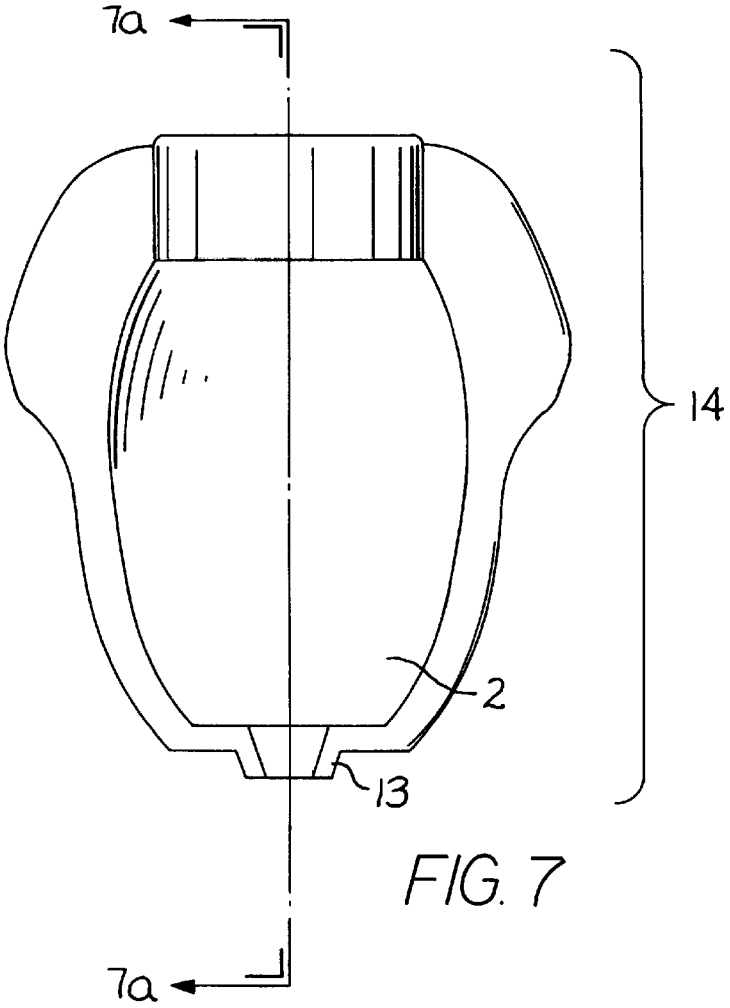
FIG. 7 is a front view of the scoop portion of the accessory.
Figure 7A:
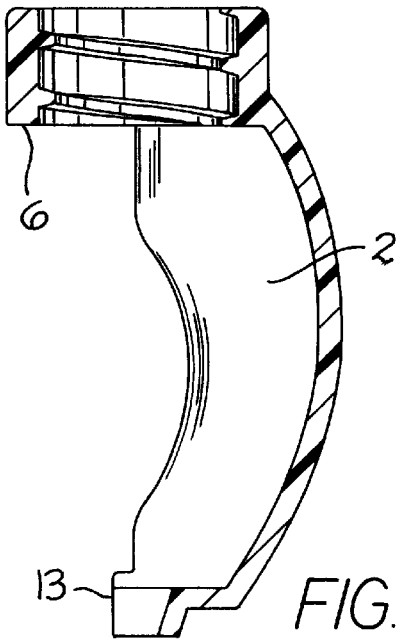
FIG. 7*a* is a cross sectional view (FIG. 7, a—a) of this scoop portion.
Figure 7B:
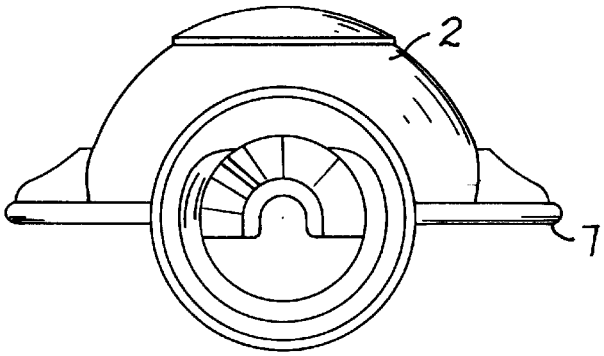
FIG. 7*b* is a top view looking down into the scoop portion.

FIGS. 7, 7*a* and 7*b* show the ball and tee receptacle 14 from the front, side (in section, a—a), and top. Thus the structure of the tee receptacle 13 is seen as well as the inside threads in collar 6 and the flared toe flanges 7. The rear view and isometric view is shown respectively in FIGS. 8 and 9.

FIGS. 10 to 13, illustrate the molded tab 9 and associated flexible finger, formed by slitting the cylindrical threaded tube 8 to form an integral one piece locking device to hold the two units 14, 17 together. This eliminates the need for additional elements such as snap rings and / or other types of locking fasteners. Thus, after assembly of the two units into the complete assembly they cannot inadvertently become separated. The tab 9 simply is pressed inwardly as it enters the collar 6 and then the threads are rotated until the tab exits below the collar 6 when the tab elastically springs back into place to lock the two units 14 and 17 together.

Having therefore introduced a novel and improved golfer's accessory into the art, those features of novelty representative of the spirit and nature of the invention are set forth in particularity in the following claims.

I claim:

1. A golfer's accessory for positioning and retrieving golf balls and tee, comprising in combination:

a generally cylindrical shaped coupling unit with coaxially arranged clamping members arranged about a cylindrical axis for attachment about a handle of a golf club disposed at one end and a cylindrical tube with male threads on the outer surface disposed at an opposite end, said cylindrical tube having an end opening shaped to seat upon a golf ball, and a mating golf ball and tee receptacle unit having mating female thread disposed at one end within a cylindrical collar for mating coaxially with the threaded cylindrical tube along the cylindrical axis to move coaxially along the cylindrical axis, and a scoop shaped receptacle extending from the collar toward an opposite end presenting a substantially semi-spherical concave surface for receiving and retaining a golf ball removably thereinto with a diameter of the golf ball aligned with said cylindrical axis and said end opening of the cylindrical tube whereby rotation of the mating receptacle unit will serve to retain the golf ball and clamp it in the scoop shaped receptacle.

2. The accessory of claim 1 further comprising a recessed golf tee head retaining semi-cylindrical receptacle positioned to retain a tee in alignment along said axis in a position mating with golf ball to permit placement of the ball and tee together into a teed-up location and to permit removal of the accessory from the teed-up ball by rotation of the threads to loosen the golf ball permitting lateral movement of the scoop shaped receptacle away from the teed-up golf ball and tee.

3. The accessory of claim 1 wherein the coaxially arranged clamping members further comprise a set of flexible fingers of predetermined length converging elastically outwardly from the cylindrical axis for surrounding an end of a golf club handle, an elastic O-ring encompassing the fingers having a diameter for flexing the fingers inwardly to clamp securely upon the golf club handle, and outer ribbed detenting means aligned along the length of the fingers for retaining the O-ring in at least two stable positions respectively for letting the fingers flex outwardly and for clamping the fingers securely upon the golf club handle.

4. The accessory of claim 3 wherein the flexible fingers are of a substantially T-shaped cross section to extend ridges inwardly toward the cylindrical axis.

5. The accessory of claim 2 wherein the mating receptacle unit further comprises a pair of diametrically directed flanges extending outwardly from said collar to receive a golfer's toe when unloosening the threads clamping the golf ball in place without rotating the ball or tee when the ball is in a teed up position with the tee inserted into the ground.

6. The accessory of claim 1 wherein the coupling unit and the receptacle unit are both integral single piece molded light weight plastic members.

7. The accessory of claim 6 wherein the plastic members are made of polypropylene.

8. In a golfer's accessory that permits a standing golfer to position and retrieve golf balls and tees, said accessory being of a size that can be carried in a golfer's pocket, the improvement comprising, a substantially semi-spherical scoop shaped golf ball and tee retention member presenting with access at one open side a substantially semi-spherical ball retention cavity for permitting a golfer to scoop balls out of a cup solely with a scooping action and comprising further mechanically actuable ball gripping means for retaining ball and tee juxta-positioned for placement into a teed-up position with the accessory out of contact with the ground, said mechanically actuable ball gripping means further comprising means for selectively and removably retaining a golf ball and tee in said retention cavity in juxta-position aligned for teeing up the mated ball and tee together and permitting the tee to penetrate the ground without contact of the retention member with the ground, and means for retrieving a used tee by grasping its head with said scoop for pulling the tee from the ground and, a clamping member for removably clamping the accessory temporarily at the end of a golf club handle.

9. The accessory defined in claim 8 wherein said ball and tee retention member further comprises adjustable golf ball retaining means with mating screw threads located intermediate retention and clamping members thereby permitting relative rotation of said ball and tee retention member and said clamping member to clamp the golf ball in place in the retention cavity and alternatively to release the golf ball from the retention cavity.

10. The accessory of claim 8 wherein the ball and tee retention member further comprises means attachable to a golf club handle for entering a golf cup to retrieve a ball therefrom.

11. The accessory of claim 8 wherein the clamping member for retaining the accessory at the end of a golf club handle further comprises a set of elastically biased fingers normally in a diverging condition for insertion of a golf club handle and an O-ring surrounding the fingers movable into bistable positions (a) for permitting the fingers to remain in the diverging condition and (b) for clamping the fingers against a golf club handle in a clamped position on the golf club.

12. The accessory of claim 8 further comprising two integral single plastic pieces having respectively plastic threaded male and female mating members and locking means for locking the two single pieces together comprising an integral attached flexible detent finger formed by one of the threaded members to flex when mating the single pieces for threading together and for locking the pieces together as the male member protrudes from the female member.

* * * * *